US005638910A

United States Patent [19]

Noe et al.

[11] Patent Number: 5,638,910

[45] Date of Patent: Jun. 17, 1997

[54] DOWNHOLE SUB FOR DIRECTIONAL DRILLING

[75] Inventors: Paul Noe, Sugarland, Tex.; David Kutinsky, Nisku, Canada

[73] Assignee: Canadian Downhole Drill Systems Inc., Nisku, Canada

[21] Appl. No.: 507,776

[22] Filed: Jul. 26, 1995

[51] Int. Cl.[6] ..... E21B 7/08

[52] U.S. Cl. ..... 175/73; 175/75; 175/320

[58] Field of Search ..... 175/75, 73, 74, 175/61, 320

[56] References Cited

U.S. PATENT DOCUMENTS

| | | | |
|---|---|---|---|
| Re. 33,751 | 11/1991 | Geczy et al. | 175/61 |
| 1,836,336 | 12/1931 | Replogle | 285/181 |
| 4,577,701 | 3/1986 | Dellinger et al. | 175/61 |
| 4,836,303 | 6/1989 | Boulet et al. | 175/74 |
| 4,962,818 | 10/1990 | DeLucia | 175/75 |
| 5,022,471 | 6/1991 | Maurer et al. | 175/75 |
| 5,029,654 | 7/1991 | Wilson et al. | 175/74 |
| 5,042,597 | 8/1991 | Rehm et al. | 175/61 |
| 5,065,826 | 11/1991 | Kruger et al. | 175/75 |
| 5,125,463 | 6/1992 | Livingstone et al. | 175/74 |
| 5,343,966 | 9/1994 | Wenzel et al. | 175/74 |

FOREIGN PATENT DOCUMENTS

| | | | |
|---|---|---|---|
| 0030028 | 3/1978 | Japan | 285/181 |

*Primary Examiner*—Hoang C. Dang
*Attorney, Agent, or Firm*—Anthony R. Lambert

[57] ABSTRACT

A downhole sub for use in directional drilling with a bent sub attached to a drill bit. The drill bit is operated by a downhole motor. The downhole sub includes upper and lower tubular sections whose centers are offset from one another in the bend direction of the bent sub. The downhole sub includes an intermediate tubular section disposed between the upper and lower tubular sections, with the bore of the intermediate section included within overlap between extensions of each of the bores of the upper and lower tubular sections. The axes of the upper and lower tubular section are parallel and offset between about ¼ inch and 2 inches. The intermediate section grades gradually into the upper and lower tubular sections. The downhole sub is used by incorporation into a drill string above the bent sub and spaced from the bend sufficiently to allow the drill string to use the downhole sub as a lever to force the drill bit into the wall of the borehole.

4 Claims, 2 Drawing Sheets

DOWNHOLE SUB FOR DIRECTIONAL DRILLING

FIELD OF THE INVENTION

This invention relates to downhole subs used in directional drilling, particularly in the drilling of oil and gas wells.

BACKGROUND OF THE INVENTION

A bent sub is often used in conjunction with a downhole motor and a drill bit in a drill string to build a predetermined angle of a borehole and thus allow for directional drilling. The bent sub provides a bend in the drill string above the drill bit. By orienting the bent sub in a selected bend direction, and choosing a bent sub with a selected bend, the drill bit will advance in the bend direction an amount determined largely by the selected bend. Various prior art bent subs are known, as for example U.S. Pat. No. 5,029,654 of Wilson et al, U.S. Pat. No. 5,125,463 of Livingstone et al, U.S. Pat. No. 5,343,966 of Wenzel et al and U.S. Pat. No. 4,667,751 of Geczy et al.

In the prior art, various techniques are used to establish the location of the drill bit in the borehole. For example, U.S. Pat. No. 4,667,751 describes a technique using a system of concentric stabilizers. In addition, it is known to use weld on kick pads on the drill string above the bent sub to kick the drill string over to one side of the borehole and allow build on the opposite side. However, these prior art techniques have disadvantages, such as difficulty in passing an enlarged area in a blow out preventor or, in the case of the weld on kick pads, potentially causing damage to the drill string during welding.

SUMMARY OF THE INVENTION

The present invention provides an elegant solution to the problem of forcing the drill bit into the wall of a borehole during directional drilling.

There is therefore provided in accordance with one aspect of the invention, a downhole sub for use in directional drilling with a bent sub attached to a drill bit, the drill bit being operated by a downhole motor, the bent sub being bent in a bend direction, the downhole sub including upper and lower tubular sections whose centers are offset from one another.

For more clarity, the upper tubular section has a first tubular exterior and a first central axis, and an uphole end connectable to an upper portion of a drill string. The lower tubular section has a second tubular exterior and a second central axis, the lower tubular section being operatively connected to the upper tubular section and has a downhole end connectable to a lower portion of the drill string. The first and second axes are offset laterally from each other in the bend direction at a point between the lower and upper tubular sections, thus creating an eccentric orientation of the sub in the borehole.

In a further aspect of the invention, the downhole sub includes an intermediate tubular section disposed between the upper and lower tubular sections.

In a further aspect of the invention, the upper tubular section includes an upper bore, the intermediate tubular section includes an intermediate bore and the lower tubular section includes a lower bore and the intermediate bore is included within overlap between extensions of each of the upper bore and the lower bore.

Preferably, the axes of the upper and lower tubular section are parallel and offset between about ¼ inch and 2 inches.

The intermediate section preferably grades gradually into the upper and lower tubular sections.

The downhole sub is used by incorporation into a drill string above the bent sub and spaced from the bend sufficiently to allow the drill string to use the downhole sub as a lever to force the drill bit into the wall of the borehole.

These and further aspects of the invention are described in more detail in the detailed description and claimed in the claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
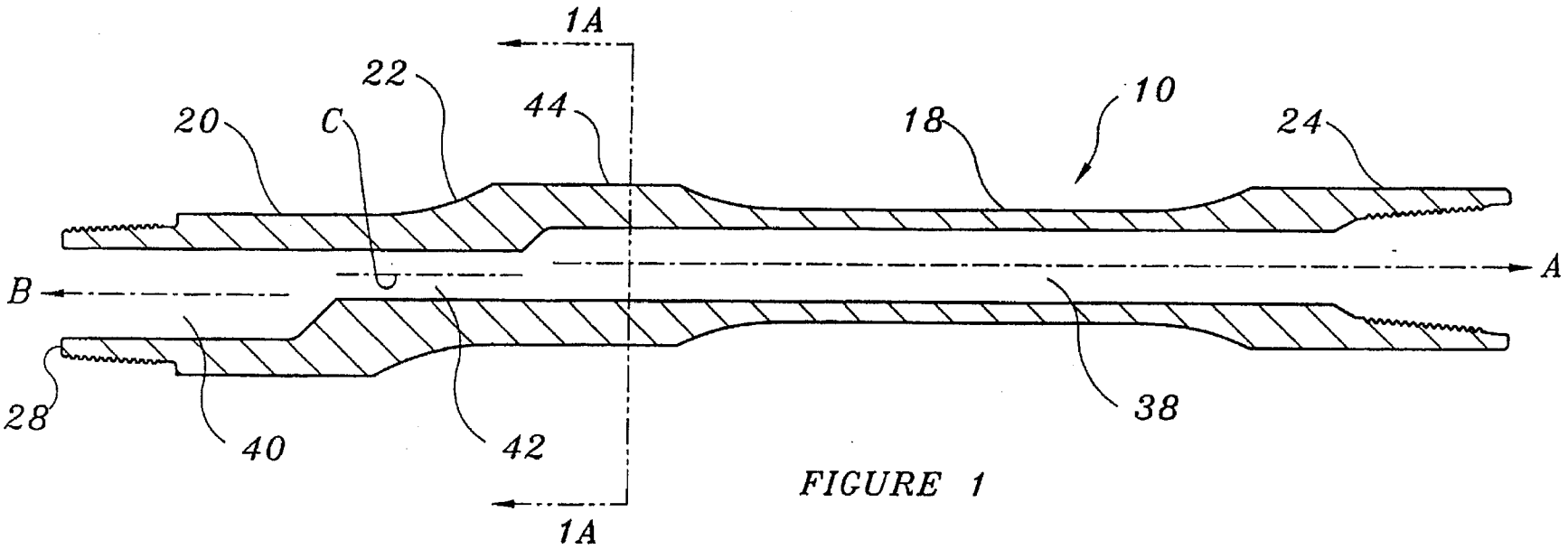
FIG. 1 is a longitudinal section showing the construction of an embodiment of the invention.
Figure 1A:
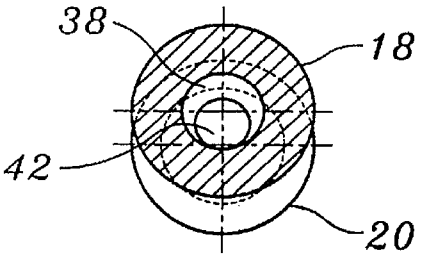
FIG. 1A is a section on the line A—A in FIG. 1 partly showing a view of the upper portion of the downhole sub of FIG. 1.
Figure 3:
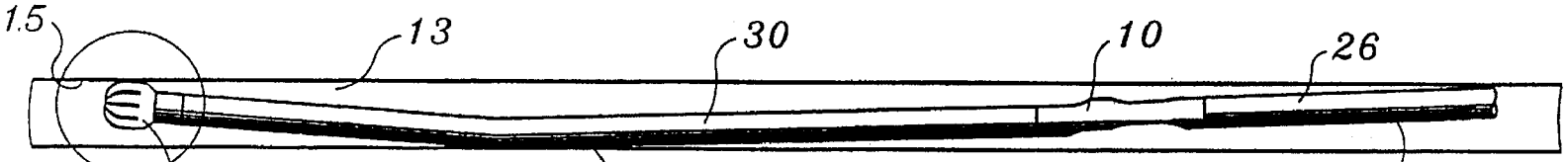
FIG. 3 is a schematic showing an embodiment of the invention including drill bit, bent sub and offset sub in a well bore.

Referring to FIGS. 1, 1A and 3, there is shown a downhole sub 10 in a drill string 12 above a bent sub 14 and drill bit 16. The drill string 12 is located in a borehole 13. Apart from the downhole sub 10, the drill string 12 is a conventional bent sub downhole motor assembly. The bent sub 14 is bent in a bend direction (parallel to the plane of FIG. 3 and the plane of the axes of FIG. 1 when the offset sub is in operation). The downhole sub 10 is formed of an upper tubular section 18, a lower tubular section 20 and an intermediate tubular section 22. Upper tubular section 18 is threaded at one uphole end 24 for connection to an upper portion 26 of drill string 12. Lower tubular section 20 is threaded at downhole end 28 for connection to a lower portion 30 of the drill string 12 containing a mud motor (not shown) or like device. The mud motor is conveniently located above the bend of the bent sub but may be below the bend of the bent sub or may be incorporated within the mud motor.

The upper tubular section 18 has a tubular exterior with a central axis A. The lower tubular section 20 has a tubular exterior with a central axis B. As shown in FIGS. 1 and 1A, the tubular exteriors of the upper tubular section 18 and lower tubular section 20 are parallel to each other and laterally offset from each other in the bend direction at a point between the upper and lower tubular sections 18 and 20. The tubular exteriors of the upper and lower tubular sections 18 and 20 need not be the same diameter, and in fact the diameter of each section can vary along the length of the tool. Equivalently, since the tubular exteriors are defined by the axes A and B, the axes A and B are laterally offset from each other in the bend direction. It is not necessary that the lateral offset be only in the bend direction, only that some portion is. It is preferred that the offset be aligned with the bend direction. By parallel is meant that extensions of the tubular exterior surfaces are parallel, since the extensions themselves do not overlap. The axes are preferably offset laterally by between about ¼ inch and 2 inches. The offset of axes A and B shown in FIG. 1 is 0.88 inches, in a tool having a outside diameter of 3.5 inches in the lower tubular section 20. Conceivably, the axes A and B do not need to be parallel, but this results in a complicated geometry.

Preferably, for ease of manufacture, the upper and lower tubular sections are connected by an intermediate tubular section 22 into which each of the upper and lower tubular sections 18 and 20 are smoothly graded. The upper tubular section 18 includes an upper bore 38 concentric with the tubular exterior of the upper tubular section 18. The lower tubular section 20 includes a lower bore 40 concentric with the tubular exterior of the lower tubular section 20. The intermediate tubular section includes an intermediate bore 42 whose axis C is offset from both axes A and B. The intermediate bore 42 extends a little way into each of the upper and lower tubular sections. The intermediate bore 42 is included within overlap between extensions of each of the upper bore 38 and the lower bore 40, as shown in FIG. 1A. An enlarged portion 44 of the downhole sub 10 may include abrasion resistant beads or like elements around its circumference to help prevent wear against the sides of the borehole.

The downhole sub 10 is located in the drill string above the bent sub 14 and spaced from the bend sufficiently to allow the drill string 12 to use the downhole sub 10 as a lever to force the drill bit 16 into the wall 15 of the borehole. Conveniently, the power section of the mud motor assembly or like device may be placed in the drill string 12 between the downhole sub 10 and the bent sub 14.

Figure 2:
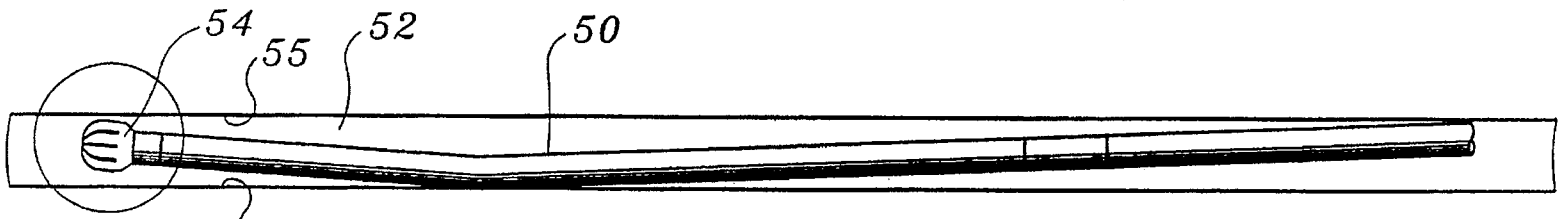
FIGURE 2 PRIOR ART
FIG. 2 is a schematic showing a prior art bent sub in location in a well bore.
Figure 4:
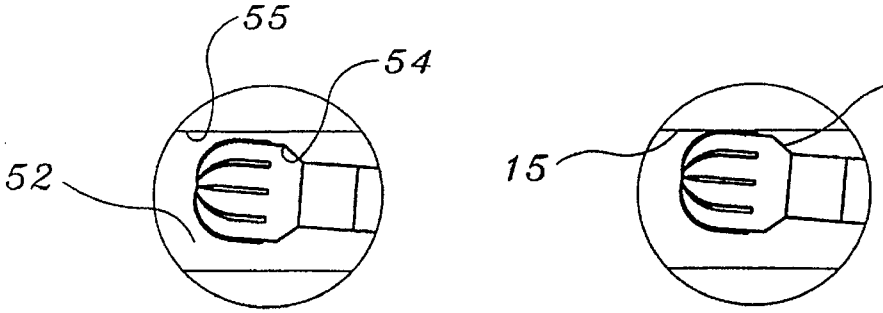
FIGURE 4 PRIOR ART
FIG. 4 is a detail of the drill bit of FIG. 2 in the location shown in FIG. 2.

The operation of the offset flex sub of the invention is best appreciated by reference to the prior art illustrated in FIGS. 2 and 4. A bent sub 50 with a predetermined bend, typically 1°–2°, is located in a borehole 52 with the bent sub 50 pressing against one wall 53 of the borehole. The pressing action against the wall 53 of the borehole forces the drill bit 54 towards the opposed wall 55. However, without some leverage action uphole the drill bit 54 may not bore into the wall 55, as quickly as desired. As drilling progress, the drill bit 54 then may not build the angle required.

Figure 5:
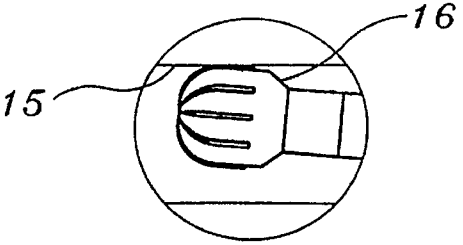
FIG. 5 is a detail of the drill bit of FIG. 3 in the position shown in FIG. 3.

Now referring to FIGS. 3 and 5, the offset flex sub of the invention allows a greater fulcrum action at the downhole sub 10, such that the drill bit 16 is forced into the wall 15 of the borehole, allowing a desired build of angle of the borehole to be easily commenced without the use of weld on kick pads.

A person skilled in the art could make immaterial modifications to the invention described and claimed in this patent without departing from the essence of the invention.

The embodiments of the invention in which an exclusive property or privilege is claimed are defined as follows:

1. A downhole drilling system for use in a borehole having a wall, the downhole drilling system comprising:

a drill string having a downhole end and a drill bit at the downhole end;

a bent sub in the drill string above the drill bit, the bent sub being bent in a bend direction;

a downhole sub in the drill string above the bent sub and spaced from the bend sufficiently to allow the drill string to use the downhole sub as a lever to force the drill bit into the wall of the borehole, the downhole sub including:

an upper tubular section having a first tubular exterior and a first central axis, the upper tubular section having an uphole end connectable to an upper portion of a drill string;

a lower tubular section having a second tubular exterior and a second central axis, the lower tubular section being connected to the upper tubular section and having a downhole end connectable to a lower portion of the drill string;

an intermediate tubular section disposed between the upper and lower tubular sections; and the first and second axes being parallel to each other and being offset laterally from each other in the bend direction at a point between the lower and upper tubular sections.

2. The downhole sub of claim 1 in which the upper tubular section includes an upper bore, the intermediate tubular section includes an intermediate bore and the lower tubular section includes a lower bore and the intermediate bore is included within overlap between extensions of each of the upper bore and the lower bore.

3. The downhole drilling system of claim 2 in which the offset is between about ¼ inch and 2 inches.

4. The downhole drilling system of claim 2 in which the intermediate section grades gradually into the upper and lower tubular sections.

* * * * *